US006440045B1

(12) United States Patent
Gaston

(10) Patent No.: US 6,440,045 B1
(45) Date of Patent: Aug. 27, 2002

(54) ABDOMINAL EXERCISE APPARATUS AND METHOD

(76) Inventor: Kerry R. Gaston, 316 Chrystan Ct., Montgomery, AL (US) 36109

( * ) Notice: Subject to any disclaimer, the term of this patent is extended or adjusted under 35 U.S.C. 154(b) by 0 days.

(21) Appl. No.: 09/298,565

(22) Filed: Apr. 22, 1999

(51) Int. Cl.[7] ..... A63B 26/00; A63B 71/00

(52) U.S. Cl. ..... 482/140; 482/72; 482/91

(58) Field of Search ..... 482/140, 142, 482/130, 132, 133, 134, 137, 138, 136, 129, 70, 80, 120, 54, 66, 71, 72, 91, 907, 908

(56) References Cited

U.S. PATENT DOCUMENTS

| | | | | | |
|---|---|---|---|---|---|
| 2,129,262 | A | * | 9/1938 | Cole | 272/57 |
| 3,101,944 | A | * | 8/1963 | Cencig | 272/79 |
| 3,130,968 | A | | 4/1964 | De Feen | |
| 3,394,934 | A | * | 7/1968 | Elia et al. | 272/72 |
| 3,572,701 | A | | 3/1971 | Agamian | |
| 3,589,720 | A | * | 6/1971 | Agamian | 272/80 |
| 4,846,465 | A | * | 7/1989 | Iams et al. | 272/127 |
| 4,858,918 | A | | 8/1989 | Iams et al. | |
| 5,277,681 | A | * | 1/1994 | Holt | 482/112 |
| 5,499,961 | A | | 3/1996 | Mattox | |
| 5,518,483 | A | | 5/1996 | Oswald | |
| 5,749,811 | A | * | 5/1998 | Wilson | 482/71 |
| 5,904,641 | A | * | 5/1999 | Huang | 482/131 |
| 6,106,442 | A | * | 8/2000 | Tissue | 482/71 |
| 6,273,841 | B1 | * | 8/2001 | Johnston | 482/51 |

* cited by examiner

*Primary Examiner*—Michael A. Brown
*Assistant Examiner*—Lori Baker Amerson
(74) *Attorney, Agent, or Firm*—Leydig, Voit & Mayer, Ltd.

(57) ABSTRACT

An abdominal exercise apparatus which is pivotally adjustable. The apparatus is configured to rest on a floor and support a user's hands and knees during operation and includes a guide member having at least one elongate rail, a movable support member mounted to the elongate rail for slidable movement thereon and a stationary base with the guide member being pivotably mounted to the stationary base for angular adjustment of the guide member relative to the stationary base about an axis substantially perpendicular to the floor. The guide member can be pivoted relative to the stationary base to position the guide member angularly from the stationary base for conditioning abdominal oblique muscles. Furthermore, the guide member can be pivoted approximately 180° to facilitate storage and transport of the apparatus. In an embodiment, control over the sliding resistance between the movable support member and the elongate rail of the guide member is provided. Also disclosed is a method for exercising and conditioning the abdominal muscles of a human.

4 Claims, 10 Drawing Sheets

ABDOMINAL EXERCISE APPARATUS AND METHOD

BACKGROUND OF THE INVENTION

The present invention generally relates to exercise equipment. The invention is particularly concerned with an apparatus and method for exercising the muscles of the human abdomen.

There are numerous abdominal exercises which an individual may practice in order to decrease abdominal girth, strengthen the abdominal muscles and maintain abdominal muscle tone. Numerous health and fitness goals can be attained through a dedicated exercise regimen directed toward one's abdominal muscles.

Known exercise apparatus and exercise methods directed towards the abdominal muscles have various disadvantages. Frequently, a particular exercise may be directed toward conditioning a large number of muscle groups such as those located in the arms, back, shoulders, chest and abdomen. Exercises attempting to condition multiple muscle groups provide insufficient focus on the abdominal muscles for effectively conditioning these muscles. Proper conditioning of abdominal muscles requires one to be able to move either the upper portion of the body while not moving the lower portion of the body or by moving the lower portion of the body while not moving the upper portion of the body. Either of these techniques enables one to specifically focus upon conditioning the abdominal muscles. Furthermore, known exercise devices and methods directed towards the abdominal muscles only allow abdominal muscles located in the front of the abdomen to be conditioned without being adjustable to allow for conditioning abdominal muscles located towards the sides of the abdomen, known as the obliques. Prior attempts at creating equipment for abdominal conditioning failed to be effective due to either motion of both the upper and lower portions of the body due to the overextension of either the upper or lower portions of the body, or due to an inability to be adjusted to properly focus on specific abdominal muscles or groups of muscles.

Also, known exercise apparatus and exercise methods directed towards conditioning abdominal muscles are uncomfortable and even dangerous to use. The lack of comfort originates from a lack of properly padded equipment. Also, the lack of comfort is from equipment whose proper use places the user in unnatural or contorted positions.

Still further, known exercise devices have the potential to be dangerous. These exercise devices are known to have hooks, straps, stirrups and other attachments which could injure the user. For example, some exercise devices have springs that may be stretched and exert a large amount of force on the hooks and connections of the springs to other components. If one of these connections or hooks were to fail under this load, both the failed hook and the spring could potentially injure a user or bystander.

Therefore, a need exists for an improved exercise apparatus and method. Such a system is needed which overcomes the previously described deficiencies of known exercise devices and methods. In particular, a need exists for an apparatus and method that provides a focused conditioning of the abdominal muscles and which eliminates hooks and interconnections for enhanced safety. A further need exists for an exercise apparatus that provides a focused conditioning of the human abdominal muscles that is comfortable and simple to use, compact and lightweight for ease of storage and transportation and relatively simple to construct. An additional need exists for an exercise apparatus that may be easily adjusted to condition the oblique abdominal muscles and for accommodating a wide variety of body sizes and that provides an effective and focused conditioning of the desired abdominal muscles in a relatively short amount of time.

SUMMARY OF THE INVENTION

In accordance with these needs, the present invention is generally realized in an apparatus for physical exercise which rests on a floor during operation and includes a movable support member which is slidably mounted on an elongate rail of a guide member. The guide member is pivotably mounted to a stationary base.

More particularly in an embodiment of the invention, the guide member is pivotably mounted to the stationary base with a removable hinge. The removable hinge between the guide member and the stationary base allows the guide member to be pivoted or rotated about an axis which passes through the removable hinge and which is substantially perpendicular to the floor during use of the present invention. Pivoting the guide member relative to the stationary base allows the user to condition the abdominal oblique muscles located towards the sides of the abdomen. Additionally, the removable hinge allows the guide member to be pivoted into a position above the stationary base to produce a compact apparatus for efficient storage.

In an embodiment of the present invention, the guide member includes two substantially parallel elongate rails. The two elongate rails are arranged such that the movable support member can engage the elongate rails while slidably traversing along the elongate rails in a direction which is generally parallel to the axes of the elongate rails.

In an embodiment, the movable support member includes opposite first and second outer lateral sides. The movable support member is slidably supported by said rails generally along these first and second outer sides.

Additionally, an embodiment of the invention involves an abdominal exercise method. The abdominal exercise method is comprised of the steps of providing an embodiment of the inventive abdominal exercise apparatus, and pivoting the guide member to the desired position relative to the stationary base. The abdominal exercise method can include the additional steps of placing the user's knees in contact with a knee rest connected to the stationary base, grasping a movable support member slidably connected with a rail, and sliding the movable support member for abdominal exercise.

Therefore, it is a primary object of the present invention to provide an abdominal exercise apparatus.

It is a further object of the present invention to provide an abdominal exercise apparatus that is comfortable and safe to use.

It is an additional object of the present invention to provide an abdominal exercise apparatus which allows the user to move either their upper body or their lower body while holding the other stationary.

It is an additional object of the present invention to provide an abdominal exercise apparatus that is compact and lightweight for ease of storage and transportation.

It is a further object of the present invention to provide an abdominal exercise apparatus which is pivotally adjustable about an axis substantially perpendicular to the floor to facilitate exercise of the abdominal oblique muscles.

It is a further object of the present invention to provide an abdominal exercise apparatus having a stationary base which can be configured for use as an aerobic step in conjunction with an aerobic step workout.

An additional object of the present invention is to provide an abdominal exercise apparatus that is easily adjustable to accommodate a wide variety of body sizes.

A further object of the present invention is to provide an abdominal exercise apparatus that provides effective and isolated conditioning of abdominal muscles in a relatively short time period.

An additional object of the present invention is to provide an improved method for exercising abdominal muscles. A related object is to provide such a method including moving a user's upper body or lower body while holding the other stationary.

These and other features and advantages of the invention will be more readily apparent upon reading the following description of a preferred exemplified embodiment of the invention and upon reference to the accompanying drawings.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DESCRIPTION OF THE PRESENTLY PREFERRED EMBODIMENT

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

Figure 1:
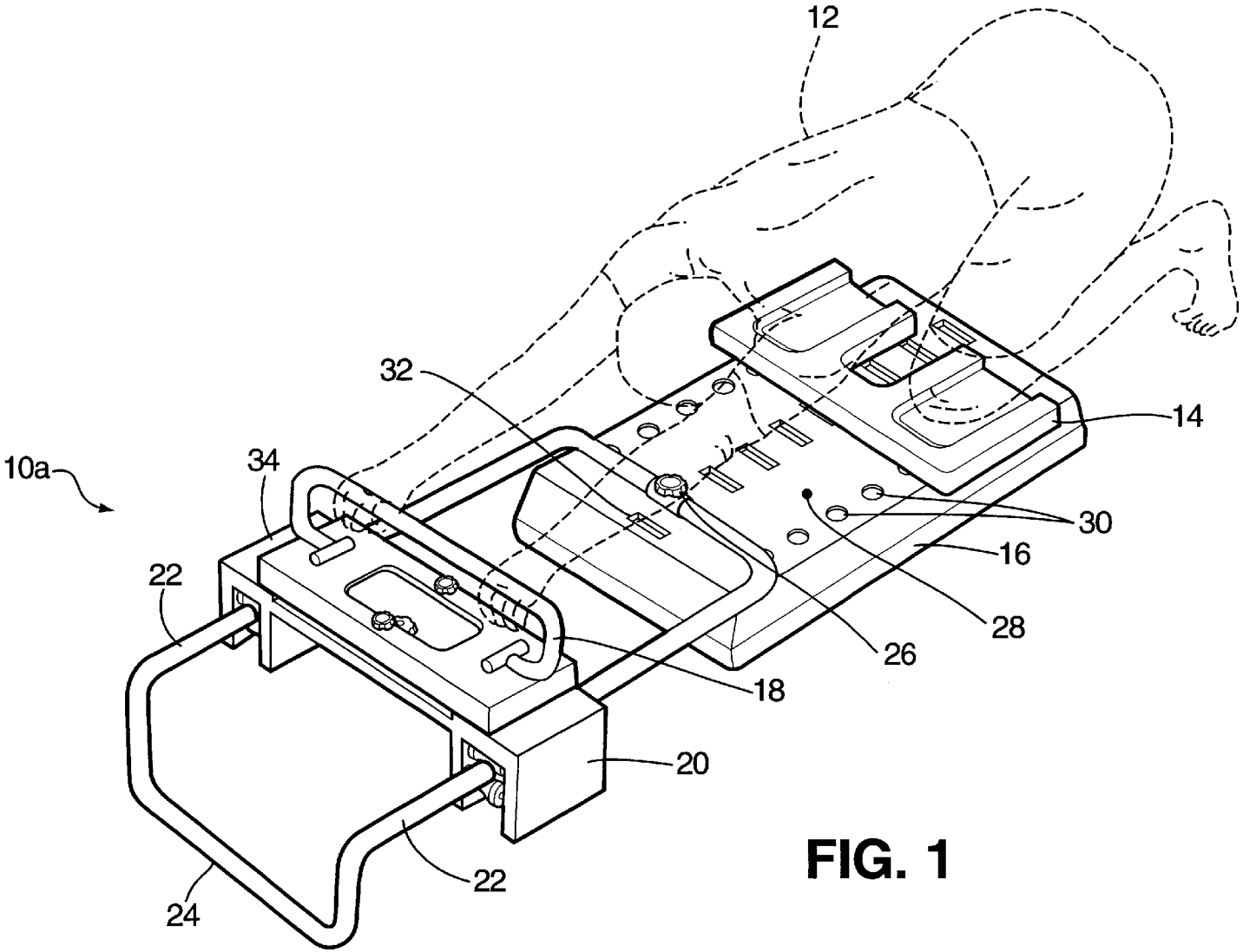
FIG. 1 is perspective view of an abdominal exercise apparatus having features according to teachings of the invention, illustrating a user in phantom lines.

Referring now to the drawings, and more particularly to FIGS. 1 through 7. Referring specifically to FIG. 1, a user 12 of the exercise apparatus 10*a* places their knees into a knee rest 14 attached to a stationary base 16. The user 12 then grasps the hand grip 18 which is attached to the movable support member 20. To exercise or condition the abdomen of the user 12, the user 12 slides the movable support member 20 towards and/or away from the stationary base 16 along the elongate rail 22 portion of the guide member 24.

Figure 2:
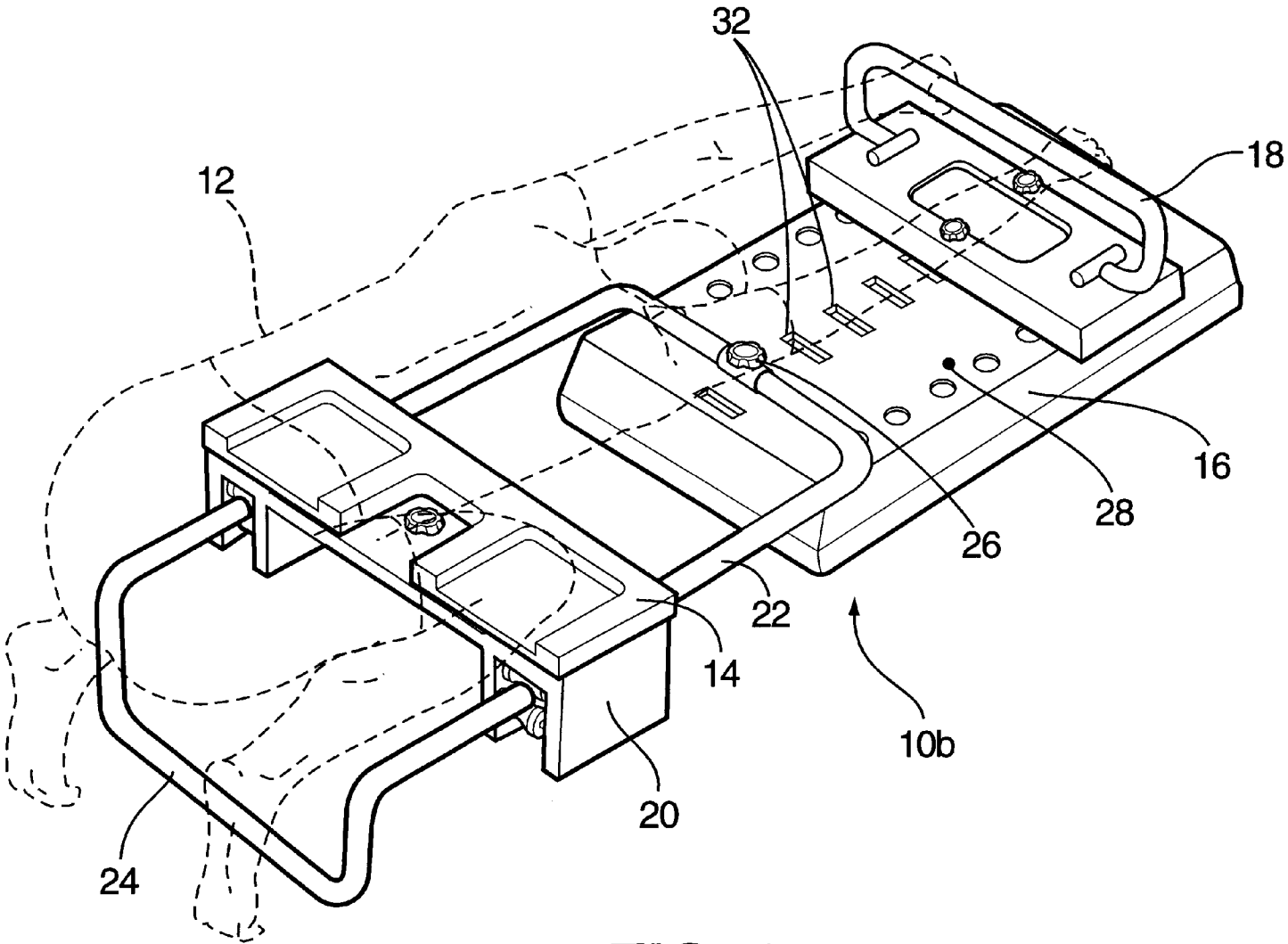
FIG. 2 is perspective view of an abdominal exercise apparatus having features according to teachings of the invention, illustrating a user in phantom lines.

Referring to FIG. 2, a user 12 of the exercise apparatus 10*b* places their knees into a knee rest 14 attached to a movable support member 20. The user 12 then grasps the hand grip 18 which is attached to the stationary base 16. To exercise or condition the abdomen of the user 12, the user 12 slides the movable support member 20 towards and/or away from the stationary base 16 along the elongate rail 22 portion of the guide member 24.

Figure 3:
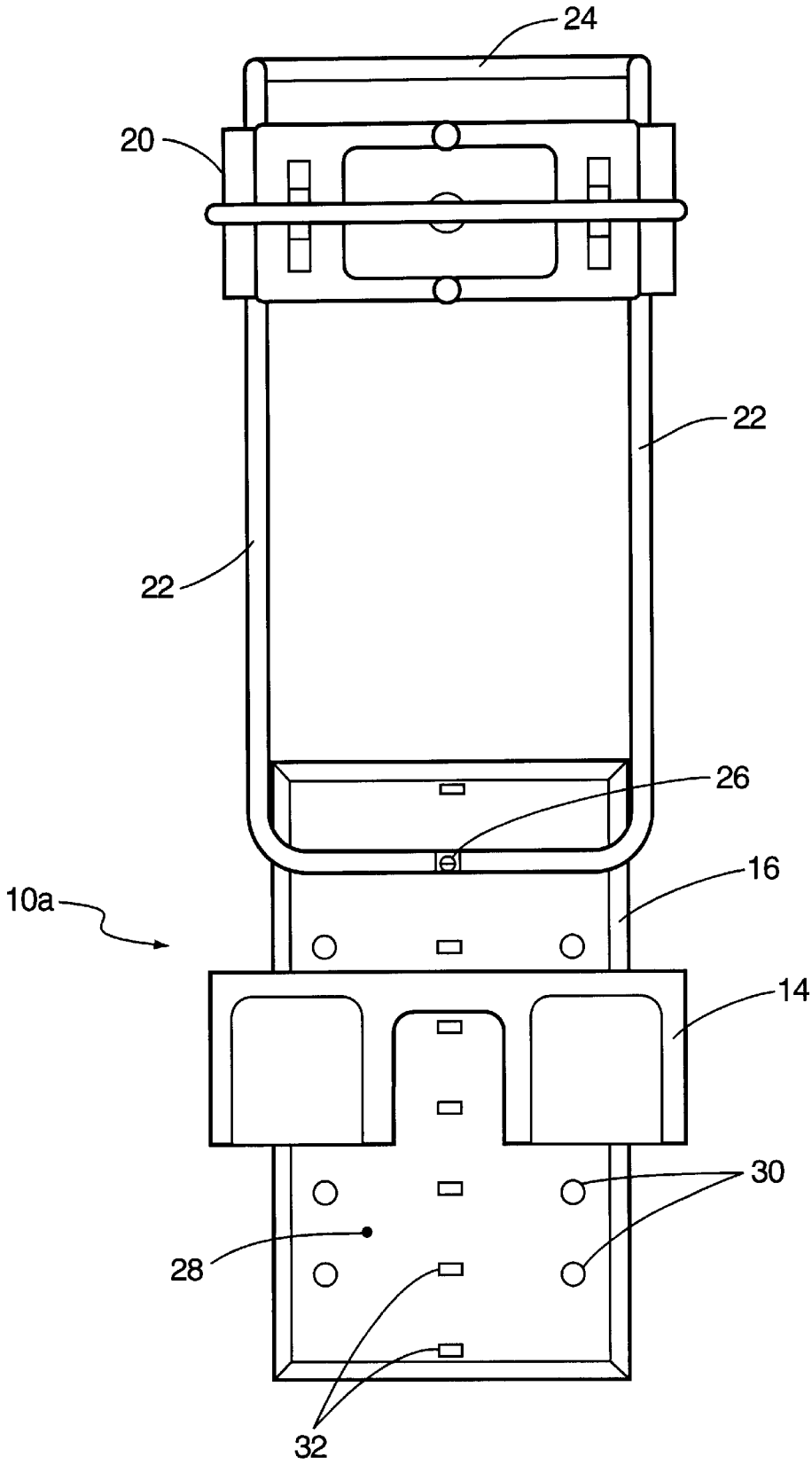
FIG. 3 is a plan view of the abdominal exercise apparatus of FIG. 1.
Figure 4:
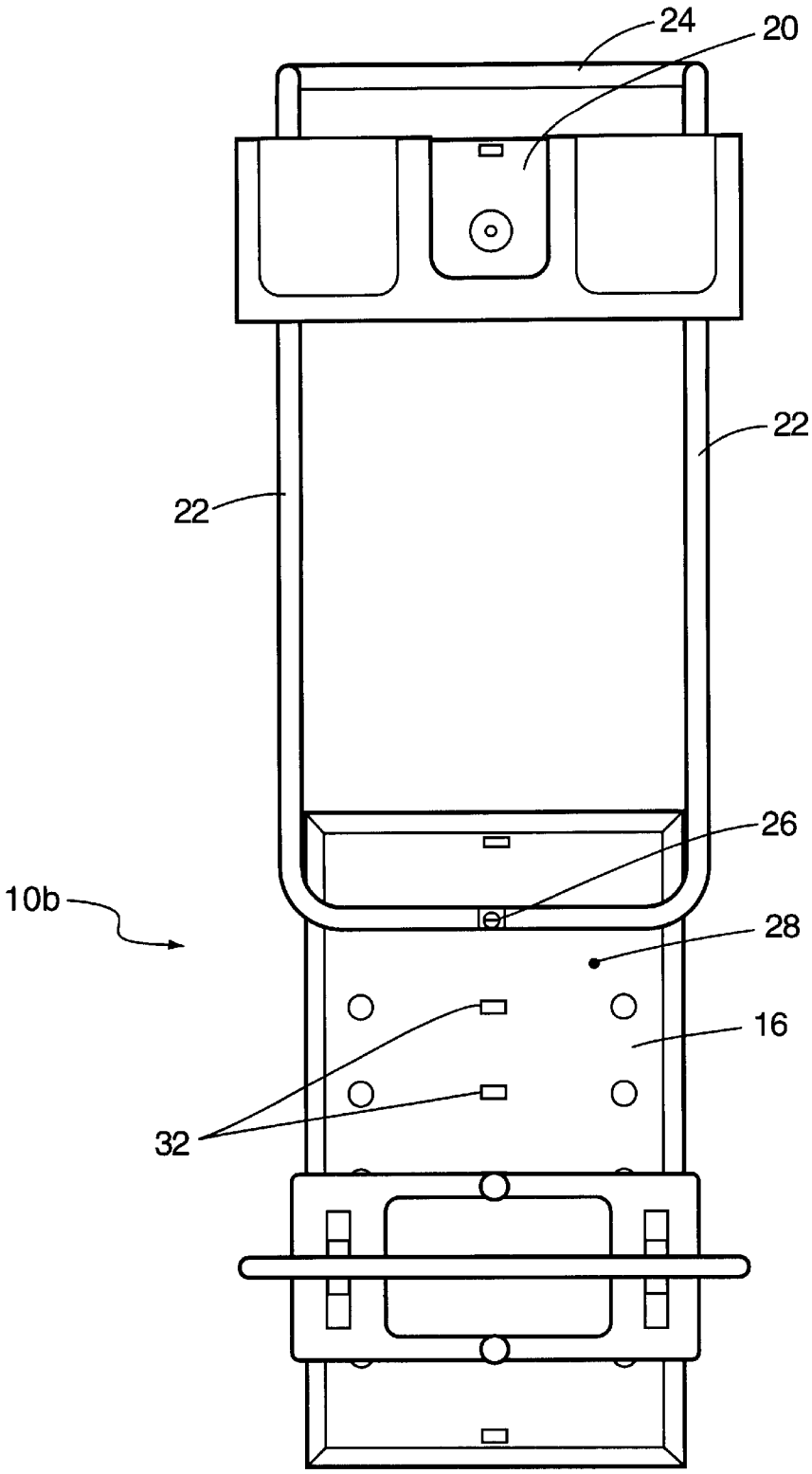
FIG. 4 is a plan view of the abdominal exercise apparatus of FIG. 2.
Figure 5:
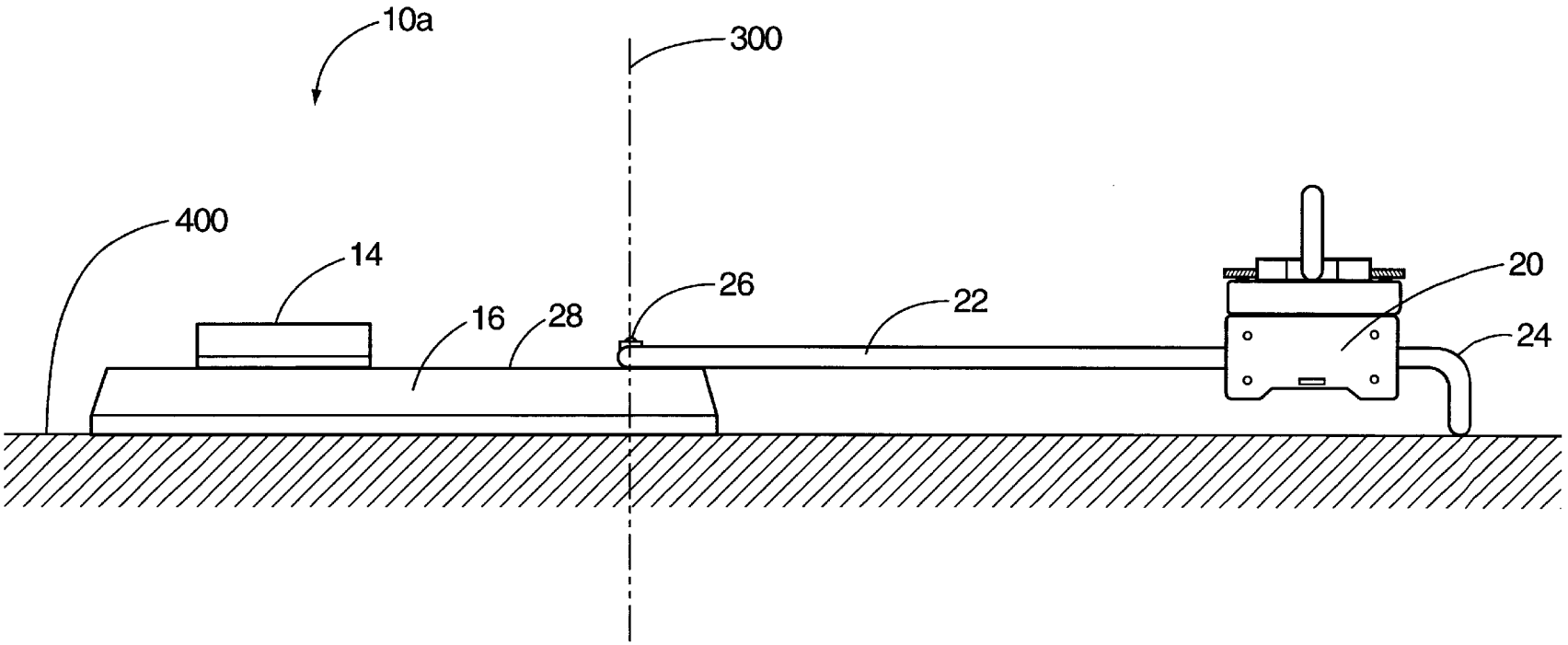
FIG. 5 is a side elevational of the abdominal exercise apparatus of FIG. 3.

As shown in FIGS. 1, 3 and 5 the guide member 24, having at least one elongate rail 22, is connected to the stationary base 16 by a removable hinge 26.Referring to FIGS. 2 and 4, the guide member 24 having at least one elongate rail 22 is connected to the stationary base 16 by a removable hinge 26. As shown in FIGS. 1, 3 and 5, the guide member 24 serves to support the exercise apparatus 10*a* on the end opposite the stationary base 16, while in FIGS. 2 and 4 the guide member 24 serves to support the exercise apparatus 10*b* on the end opposite the stationary base 16, during use of the exercise apparatus 10*b*. In FIGS. 1 through 7 the guide member 24 also provides at least one elongate rail 22. Although FIGS. 1 through 7 show the use of two elongate rails 22, this is merely exemplary and not meant to limit the invention to the use of two elongate rails. In FIGS. 1, 3 and 5, the elongate rail 22 portion of the guide member 24 allows the movable support member 20 to move slidably thereon, while in FIGS. 2 and 4, the elongate rail 22 portion of the guide member 24 allows the movable support member 20 to move slidably thereon.

Figure 6:
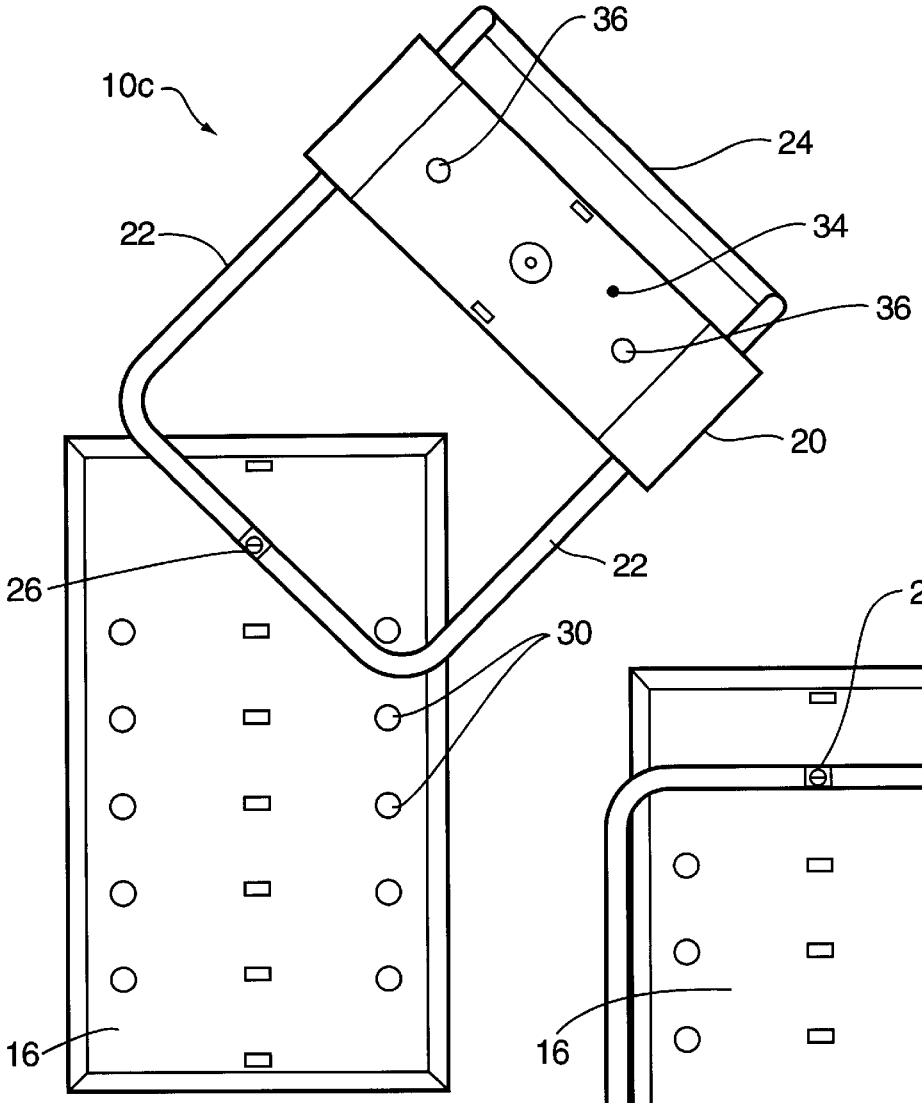
FIG. 6 is a plan view of the abdominal exercise apparatus showing the guide member pivoted relative to the stationary base about an axis substantially perpendicular to the floor.
Figure 7:
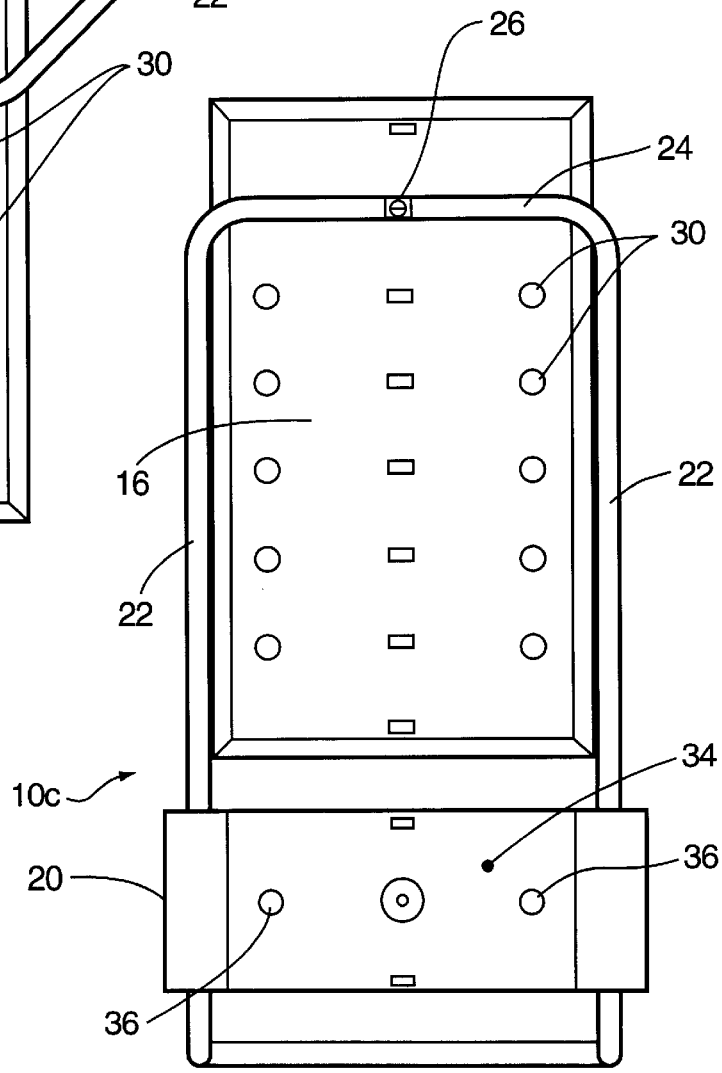
FIG. 7 is a plan view of the abdominal exercise apparatus showing the guide member pivoted for storage.

As shown in FIGS. 6 and 7, when the exercise apparatus 10*c* is in use, the movable support member 20 is mounted on the elongate rail 22 of the guide member 24 for slidable traversal thereon. As shown in FIGS. 6 and 7, the movable support member 20 has a top surface 34. Formed into the top surface 34 of the movable support member 20 is a series of holes 36 configured such that the hand grip 18 (as shown in FIG. 1) or the knee rest 14 (as shown in FIG. 2) can be received interchangeably by the top surface 34 of the movable support member 20. The holes 36 are arranged such that either the hand grip 18 (as shown in FIG. 1) or the knee rest 14 (as shown in FIG. 2) can be secured to the movable support member 20 while the user 12 operates the apparatus 10*c*. The hand grip 18 (as shown in FIG. 1) or the knee rest 14 (as shown in FIG. 2) is connected to the movable support member 20 such that each can be easily removed to configure the apparatus (as shown in either FIG. 1 or FIG. 2) as desired or to facilitate storage of the apparatus 10*c*.

As shown in FIGS. 1 through 7, the removable hinge 26 between the stationary base 16 and the guide member 24 allows the guide member 24 to be optionally connected or disconnected from the stationary base 16. As shown generally in FIG. 5, when the exercise apparatus 10*a* is in use, the stationary base 16 will be supported by a substantially planer surface 400. The planer surface can be the floor, ground or any other convenient surface.

As shown in FIGS. 6 and 7, the removable hinge 26 allows either the guide member 24 or the stationary base 16 to be rotated relative to the other about an axis 300 (shown in FIG. 5). The axis 300 is substantially perpendicular to the planer surface 400 (shown in FIG. 5) upon which the stationary base 16 rests during use. As shown in FIG. 6, the guide member 24 is rotated about the axis 300 (shown in FIG. 5) which passes through the removable hinge 26 for a user of the exercise apparatus 10*c* to condition the abdominal muscles located towards the side of the abdomen. As shown in FIG. 7, the guide member 24 can be rotated approximately 180° about the axis 300 (shown in FIG. 5) until the guide member is located above the stationary base 16 to produce a compact exercise apparatus that is easily stored or transported.

Referring to FIGS. 1, 3 and 5, the stationary base 16 has a top surface 28. Formed into the top surface 28 of the stationary base 16 is a series of holes 30 configured to receive the knee rest 14 and connect the knee rest 14 to the stationary base 16. The holes 30 are arranged such that the knee rest 14 is secured to the stationary base 16 while the user 12 operates the exercise apparatus 10*a* The knee rest 14 is connected to the stationary base 16 such that it can be easily removed to reconfigure the apparatus 10*b* (as shown in FIG. 2) or to facilitate storage of the apparatus 10*c* (as shown in FIG. 7).

Referring to FIGS. 1, 3 and 5, a plurality of apertures 32 are formed into the top surface 28 of the stationary base 16. The aperatures 32 are configured to receive the removable hinge 26. The aperatures 32 located in the top surface 28 of the stationary base 16 are positioned such that the guide member 24 can be removably connected to the stationary base 16 at any individual aperature of the plurality of aperatures 32. Since the guide member 24 can be removably connected to the stationary base 16 at any of the individual aperatures 32, the apparatus 10*a* of the present invention is fully adjustable to accommodate a wide range of user body sizes. While the guide member 24 is removably connected to the stationary base 16, the guide member 24 is capable of pivoting about the removable hinge 26. The pivotal motion of the guide member 24 is about an axis 300 (shown in FIG. 5) which is substantially perpendicular to the planer surface upon which the stationary base 16 rests during use and which passes through the removable hinge 26. The pivotal motion of the guide member 24 about the removable hinge 26 is identical to that previously described in connection with FIGS. 6 and 7.

Referring to FIGS. 2 and 4, the stationary base 16 has a top surface 28. Formed into the top surface 28 of the stationary base 16 is a series of holes 30 configured to receive the hand grip 18 and connect the hand grip 18 to the stationary base 16. The holes 30 are arranged such that the hand grip 18 is secured to the stationary base 16 while the user 12 operates the exercise apparatus 10*b*. The hand grip 18 is connected to the stationary base 16 such that it can be easily removed to reconfigure the apparatus 10*a* (as shown in FIG. 1) or to facilitate storage of the apparatus 10*c* (as shown in FIG. 7).

Referring to FIGS. 2 and 4, a plurality of apertures 32 are formed into the top surface 28 of the stationary base 16. The apertures 32 are configured to receive the removable hinge 26. The aperatures 32 located in the top surface 28 of the stationary base 16 are positioned such that the guide member 24 can be removably connected to the stationary base 16 at any individual aperature of the plurality of aperatures 32. Since the guide member 24 can be removably connected to the stationary base 16 at any of the individual aperatures 32, the apparatus 10*b* of the present invention is fully adjustable to accommodate a wide range of user body sizes. While the guide member 24 is removably connected to the stationary base 16, the guide member 24 is capable of pivoting about the removable hinge 26. The pivotal motion of the guide member 24 is about an axis 300 (shown in FIG. 5) which is substantially perpendicular to the planer surface upon which the stationary base 16 rests during use and which passes through the removable hinge 26. The pivotal motion of the guide member 24 about the removable hinge 26 is identical to that previously described in connection with FIGS. 6 and 7.

Figure 8:
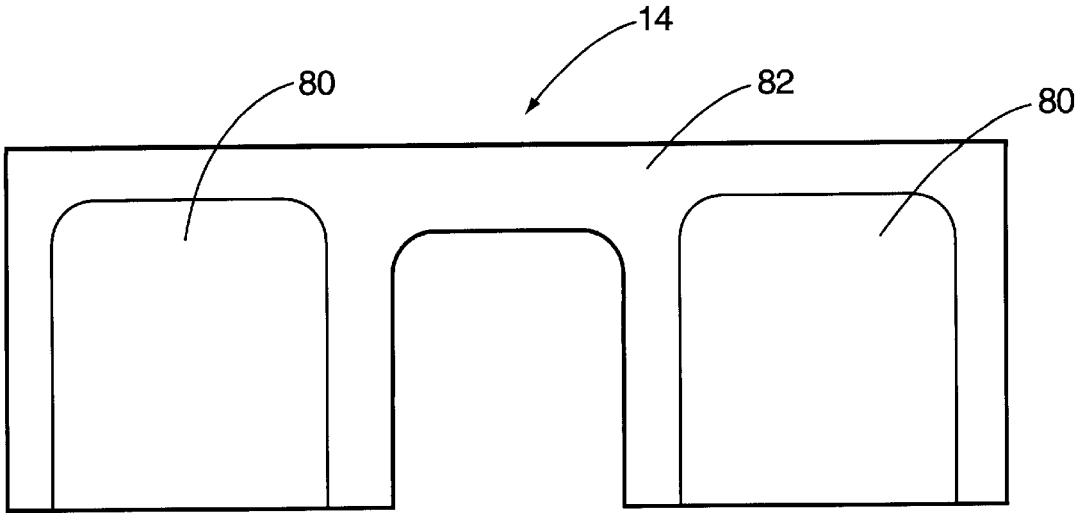
FIG. 8 is a plan view of a knee rest of the abdominal exercise apparatus.
Figure 9:
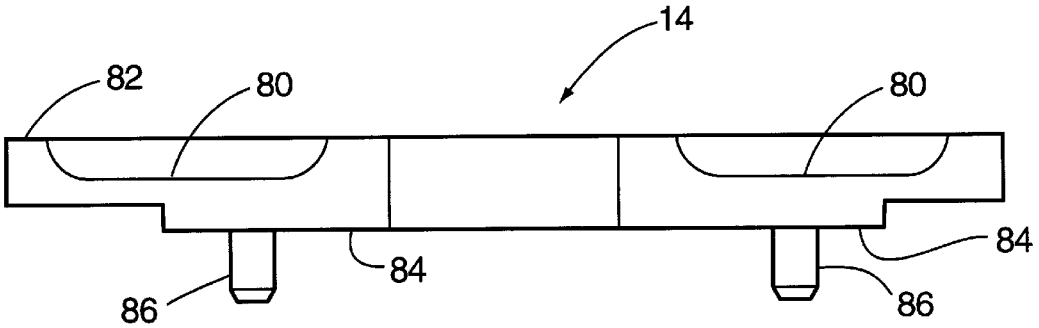
FIG. 9 is a side elevational view of the knee rest of FIG. 8.
Figure 10:
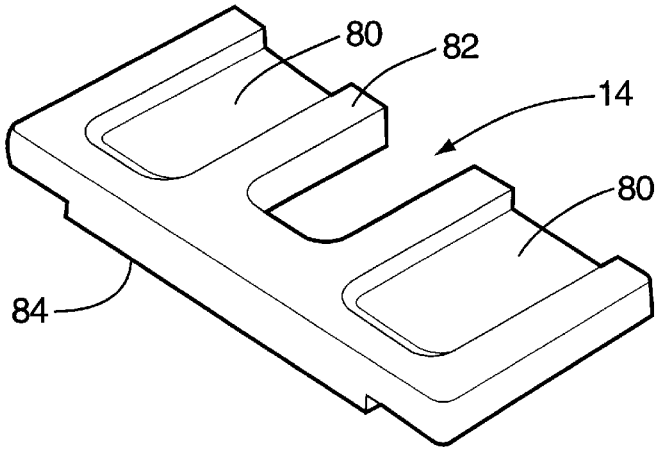
FIG. 10 is a perspective view of the knee rest of FIG. 8.

Turning now to FIGS. 8 through 10, three different views of the knee rest 14 are shown. The knee rest, designated generally by the numeral 14, contains one or more recessed areas 80 formed into the top surface 82 of the knee rest 14 for receiving the knees of the user 12. Although FIGS. 8 through 10 show the use of two recessed areas 80, one for each knee of the user, this is merely exemplary and not meant to limit the present invention. It is within the scope of the present invention to use a single recessed area large enough to receive both of the knees of the user. Projecting outwardly from the bottom surface 84 of the knee rest 14 are one or more knee-rest studs 86. In FIG. 1, the knee-rest studs 86 are received by the holes 30 in the stationary base 16 for securing the knee rest 14 to the stationary base 16. In FIG. 2, the knee-rest studs 86 are received by the holes 36 (as seen in FIGS. 6 and 7) in the movable support member 20 for securing the knee rest 14 to the movable support member 20. The interconnection of the knee rest studs 86 with the holes 30 in the stationary base 16 or the holes 36 in the movable support member 20 is such that the knee rest 14 can be easily removed from either the stationary base 16 or the movable support member 20 for reconfiguring the apparatus 10*a*, 10*b* or to facilitate storage of the apparatus 10*c*. Although not shown, the recessed areas 80 of the knee rest 14 can optionally contain a padding or friction material to contact the knees of the user 12 to improve the comfort of the user 12 during use. The knee rest 14 can be made from any acceptable material with a molded plastic being preferred due to its light weight, wide availability, common use in the art and cost effectiveness.

Figure 11:
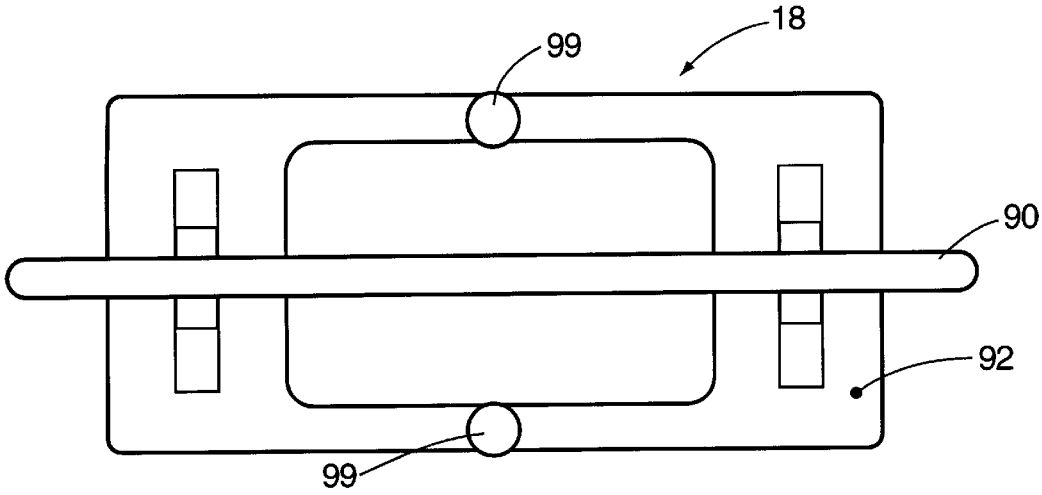
FIG. 11 is a plan view of a hand grip of the abdominal exercise apparatus.
Figure 12:
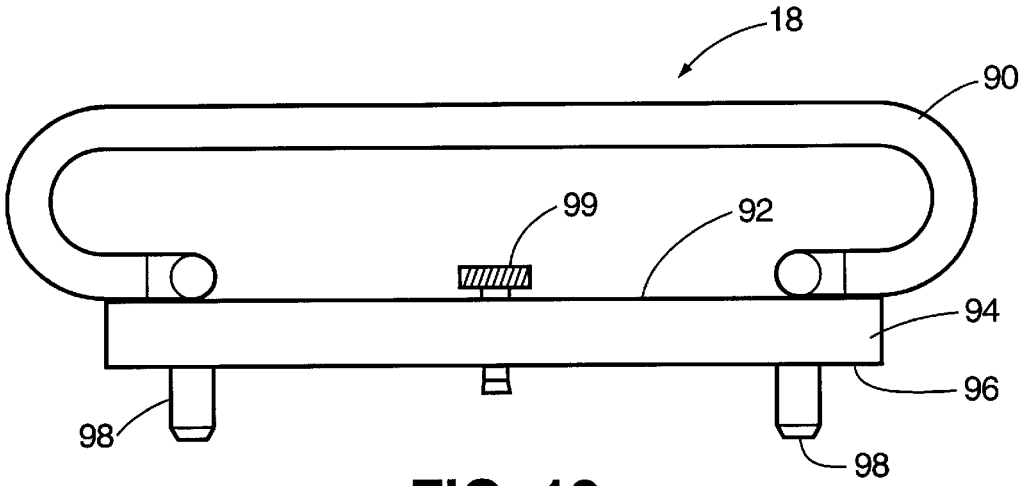
FIG. 12 is a side elevational view of the hand grip of FIG. 11.
Figure 13:
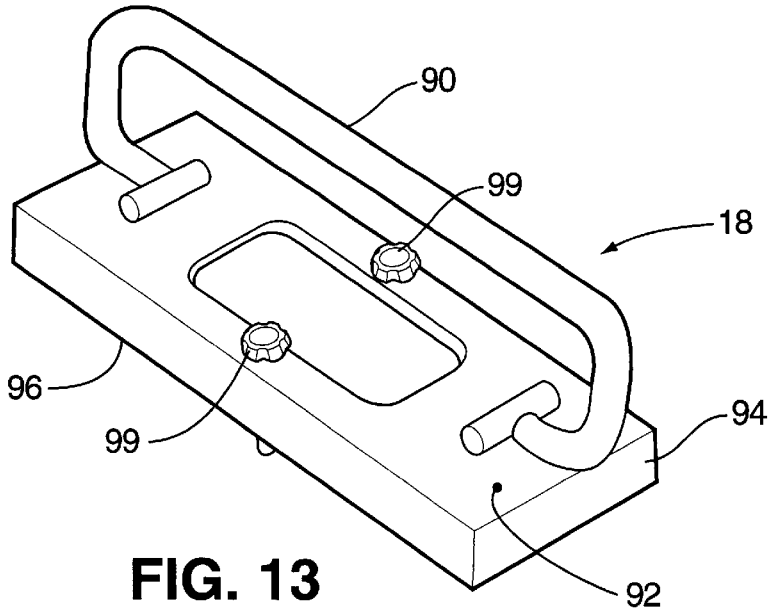
FIG. 13 is a perspective view of the hand grip of FIG. 11.

Turning now to FIGS. 11 through 13, three different views of the hand grip 18 are shown. The hand grip, designated generally by the numeral 18, includes a rigid portion 90 configured to be easily gripped by the user 12. Although not shown, the rigid portion 90 can be partially covered with an optional padded or absorbent material to maintain the user's grip on the rigid portion 90 during the abdominal workout despite the presence of perspiration from the user 12. The rigid portion 90 of the hand grip 18 is fixedly mounted to the top surface 92 hand-grip base 94. Projecting outwardly from the bottom surface 96 of the hand-grip base 94 are one or more hand-grip studs 98. In FIG. 1, the hand-grip studs 98 are received by the holes 36 (as seen in FIGS. 6 and 7) in the movable support member 20 for securing the hand grip 18 to the movable support member 20. In FIG. 2, the hand-grip studs 98 are received by the holes 30 in the stationary base 16 for securing the hand grip 18 to the stationary base 16. The interconnection of the hand-grip studs 98 with the holes 30 in the stationary base 16 or the holes 36 in the movable support member 20 is such that the hand grip 18 can be easily removed from either the stationary base 16 or the movable support member 20 for reconfiguring the apparatus 10*a*, 10*b* or to facilitate storage. Extending downwardly from above the top surface 92 of the hand-grip base 94 for engagement with the movable support member 20 (as shown in FIG. 1) or the stationary base 16 (as shown in FIG. 2) is one or more threaded members 99. The threaded members 99 connect either the movable support member 20 (shown in FIG. 1) or the stationary base 16 with the hand grip 18 (shown in FIG. 2) and functions to provide engagement in addition to that provided by the hand-grip studs 98.

Figure 14:
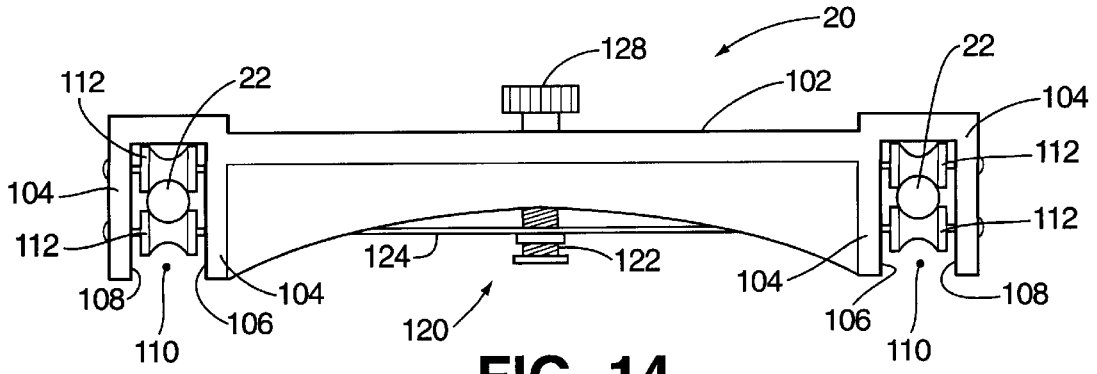
FIG. 14 is a side elevational view of a movable support member of the abdominal exercise apparatus.
Figure 15:
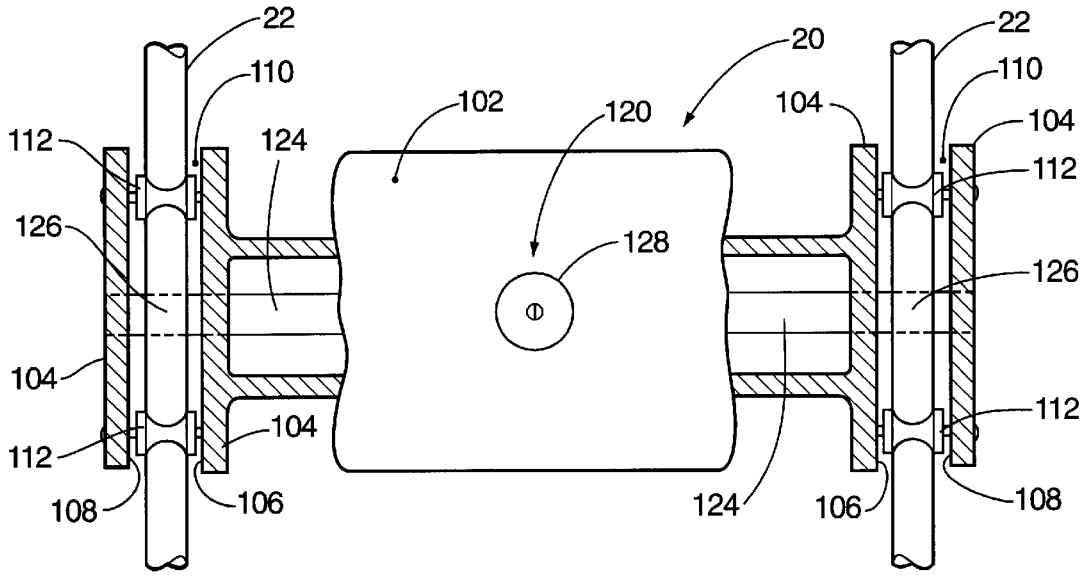
FIG. 15 is a fragmentary sectional plan view of the movable support member of FIG. 14.
Figure 16:
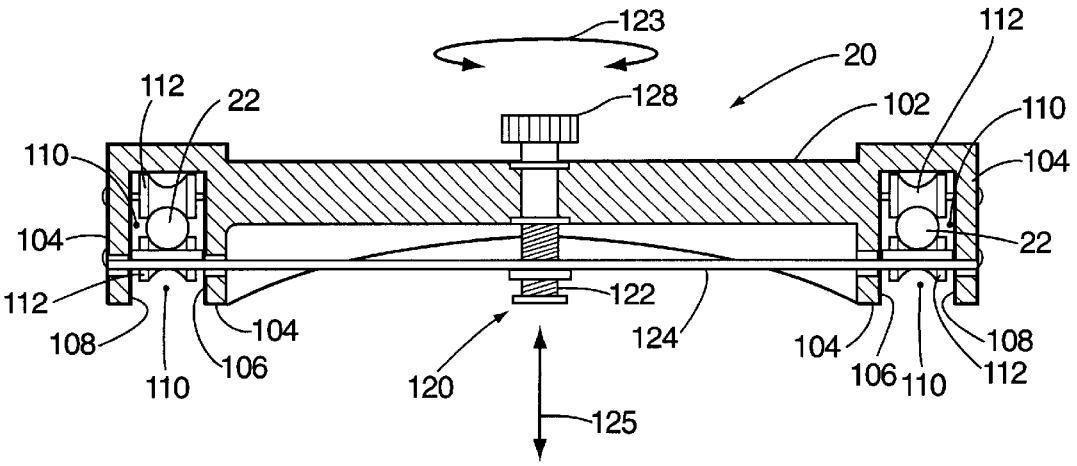
FIG. 16 is a sectional side elevational view of the movable support member of FIG. 14.

Turning now to FIGS. 14–16, three different views of the movable support member 20 are shown. The movable support member 20 of FIGS. 14–16 is identical to the movable support member 20 shown in FIGS. 1 through 7. The following description of the movable support member 20 of FIGS. 14–16 is independent of whether the movable support member 20 functions as shown in FIGS. 1, 3 and 5 or as shown in FIGS. 2 and 4.

The movable support member 20 has a top exterior surface 102 and downwardly depending side walls 104. The downwardly depending side walls 104 define one or more channeled portions 110. The channeled portions 110 include interior surfaces 106 and exterior surfaces 108. Although FIGS. 14–16 show the use of two channeled portions 110, this is merely exemplary and not meant to limit the invention to the use of two channeled portions 110. The channeled portions 110 are configured such that the elongate rail 22 (as also shown in FIGS. 1–7) is received between the interior surface 106 and the exterior surface 108 of the downwardly depending side walls 104. Mounted within the channeled portions 110 between the interior surface 106 and the exterior surface 108 is a plurality of rollers 112 which are in rolling or sliding contact with the elongate rail 22. The rolling or sliding contact of the plurality of rollers 112 with the elongate rail 22 allows the movable support member 20 to move in a direction which is substantially parallel with the elongate rail 22.

Also present in FIGS. 14–16 is a resistance assembly designated generally as 120. The resistance assembly 120 includes a rotatable threaded member 122 which extends above the top exterior surface 102 of the movable support member 20. The rotatable threaded member 122 is in threaded engagement with a substantially rigid bar 124. As the rotatable threaded member 122 is rotated 123 by the user turning the resistance control knob 128 the rotatable threaded member 122 moves in an axial direction 125 with the substantially rigid bar 124 moving in response to the axial movement 125 of the rotatable threaded member 122. The substantially rigid bar 124 has at least one friction pad 126 for optional engagement with the elongate rail 22. The engagement between the friction pad 126 and the elongate rail 22 is optional in that user 12 rotation of the resistance control knob 128 may be such that the axial movement 125 of the rotatable threaded member 122 prevents the friction pad 126 from engaging the elongate rail 22. The engagement of the friction pad 126 with the elongate rail 22 is in response to the axial movement 125 of the rotatable threaded member 122. To control the sliding resistance between the movable support member 20 and the elongate rail 22, the substantially rigid bar 124, moving in response to the rotation of the rotatable threaded member, biases the friction pads 126 against the elongate rail 22. The degree of biasing of the friction pads 126 against the elongate rail 22 determines the difficulty of the abdominal workout and is controlled by the user's rotation of the rotatable threaded member 122 through the resistance control knob 128.

Figure 17:
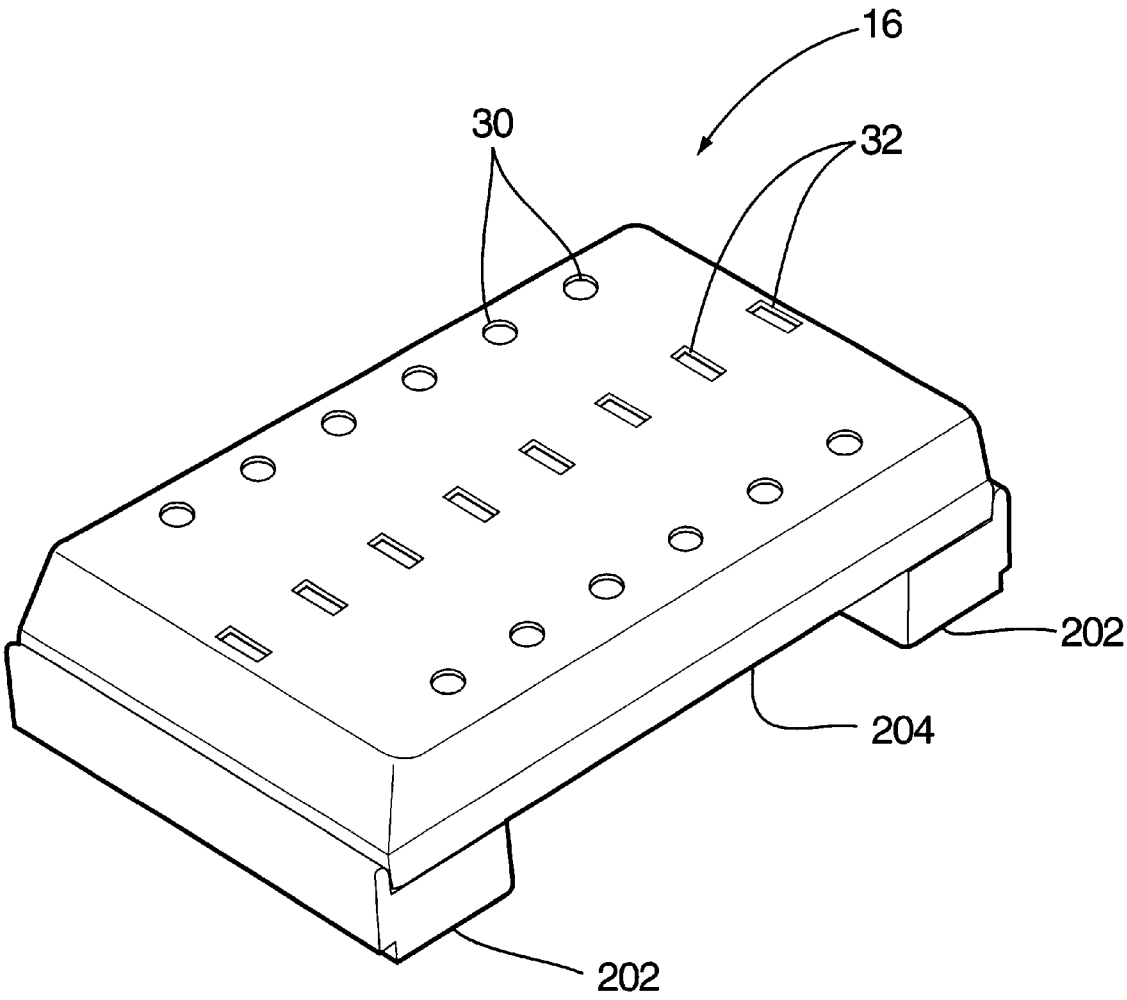
FIG. 17 is a perspective view of the stationary base assembled with a pair of spacers for use as an aerobic step.

Referring now to FIG. 17., where a perspective view of the stationary base 16 with spacers 202 is shown. The stationary base 16 is the same as the stationary base 16 shown in FIGS. 1 through 7. As described in conjunction with FIGS. 1, 3 and 5, the stationary base 16 has a series of holes 30 for receiving the knee rest studs 86 as shown in FIG. 9. Also, as described in conjunction with FIGS. 2 and 4, the holes 30 located in the stationary base 16 can also receive the hand-grip studs 98 as shown in FIG. 12. Furthermore, the stationary base 16 also contains the plurality of aperatures 32 described in conjunction with FIGS. 1 through 7. Removably attached to the bottom surface 204 of the stationary base 16 is one or more spacers 202. After removal of the removable hinge (not shown in FIG. 17 but identified with numeral 26 in FIGS. 1–7) and the guide member (not shown in FIG. 17 but identified with numeral 24 in FIGS. 1–7) having been separated from the stationary base 16, the spacers 202 are placed under the stationary base 16 for elevation, thereby, allowing the stationary base to be used as a step in conjunction with an aerobic step workout.

Thus it will be seen that a novel apparatus and method for exercising the human abdomen has been provided which attains the aforementioned objects. Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. An abdominal exercise method comprising the steps of:

providing an abdominal exercise apparatus configured to rest on a floor and support a user's hands and knees during operation, the apparatus comprising a guide member having at least one elongate rail;

a movable support member mounted to said elongate rail for slidable movement thereon; and a stationary base, said guide member being pivotably mounted to said base for angular adjustment of said guide member relative to said base about an axis substantially perpendicular to said floor;

pivoting said guide member relative to said stationary base about an axis substantially perpendicular to said floor;

placing the user's knees on a knee rest which is connected to said stationary base;

grasping said movable support member; and sliding said movable support member in a direction substantially parallel to said elongate rail.

2. An abdominal exercise method comprising the steps of:

pivoting a guide member having at least one elongated rail relative to a stationary base about an axis perpendicular to a floor;

placing a person's knees on a knee rest which is connected to said stationary base, grasping a movable support member which is slidably engaged with said rail; and sliding said movable support member in a direction substantially parallel to said rail.

3. An abdominal exercise method comprising the steps of:

providing an abdominal exercise apparatus configured to rest on a floor and support a user's hands and knees during operation, the apparatus comprising a guide member having at least one elongate rail;

a movable support member mounted to said elongate rail for slidable movement thereon; and a stationary base, said guide member being pivotably mounted to said base for angular adjustment of said guide member relative to said base about an axis substantially perpendicular to said floor;

pivoting said guide member relative to said stationary base about an axis substantially perpendicular to said floor;

placing the user's knees on a knee rest which is connected to said movable support member;

grasping said stationary base; and sliding said movable support member in a direction substatially parallel to said elongate rail.

4. An abdominal exercise method comprising the steps of:

pivoting a guide member having at least one relative to a stationary base about an axis perpendicular to a floor;

placing a person's knees on a knee rest which is connected to a movable support member wherein said movable support member is slidably engaged with said rail, grasping said stationary base, and sliding said movable support member in a direction substantially parallel to said rail.

* * * * *